US011028530B2

(12) United States Patent
Malishkevich

(10) Patent No.: US 11,028,530 B2
(45) Date of Patent: Jun. 8, 2021

(54) FOLDING GUIDE HANGER

(71) Applicant: Alex Malishkevich, Edgewater, NJ (US)

(72) Inventor: Alex Malishkevich, Edgewater, NJ (US)

( * ) Notice: Subject to any disclaimer, the term of this patent is extended or adjusted under 35 U.S.C. 154(b) by 106 days.

(21) Appl. No.: 16/288,201

(22) Filed: Feb. 28, 2019

(65) Prior Publication Data

US 2020/0277726 A1 Sep. 3, 2020

(51) Int. Cl.

| | |
|---|---|
| ***D06F 89/02*** | (2006.01) |
| ***A47G 25/40*** | (2006.01) |
| ***A47G 25/48*** | (2006.01) |

(52) U.S. Cl.

CPC ..... *D06F 89/02* (2013.01); *A47G 25/40* (2013.01); *A47G 25/4038* (2013.01); *A47G 25/48* (2013.01); *A47G 25/482* (2013.01)

(58) Field of Classification Search

CPC ..... D06F 89/00; D06F 89/02; D06F 89/023; A47G 25/4038; A47G 25/482; A47G 25/14–52; A47G 25/183; A47G 25/186; A47G 25/325; A47G 25/4015–4092; A47G 25/441–448; A47G 25/484; A47G 25/488; A47G 2025/4084; A47G 2025/4092

See application file for complete search history.

(56) References Cited

U.S. PATENT DOCUMENTS

| | | | | | |
|---|---|---|---|---|---|
| 424,275 | A | * | 3/1890 | Coles et al. | A47G 25/4038 223/85 |
| 703,110 | A | | 6/1902 | Beiermeister | |
| 869,236 | A | * | 8/1907 | Sundin | A47G 25/30 223/89 |
| 1,052,426 | A | * | 2/1913 | Ringler | D06F 59/02 223/69 |
| 1,938,921 | A | | 12/1933 | Meyer | |
| 2,226,443 | A | | 12/1940 | Schulman | |
| 2,446,312 | A | * | 8/1948 | Usina | A47G 25/4053 223/89 |
| 4,669,642 | A | * | 6/1987 | Nicholas | A47G 25/14 211/118 |
| 5,131,574 | A | | 7/1992 | Usco | |
| 5,183,190 | A | | 2/1993 | Zuckerman | |
| 5,687,888 | A | * | 11/1997 | Chang | A47G 25/4038 223/85 |

(Continued)

FOREIGN PATENT DOCUMENTS

| | | | |
|---|---|---|---|
| WO | WO 98/18371 | * | 5/1998 |
| WO | WO 2017/188691 A1 | * | 11/2017 |

*Primary Examiner* — Ismael Izaguirre

(57) ABSTRACT

A folding guide hanger for folding clothing includes a first folding guide half having a first front face, a first rear face, a first top face, a first bottom face, a first left face, and a first right face. A hanger hook is coupled to the first folding guide half. A second folding guide half has a second front face, a second rear face, a second top face, a second bottom face, a second left face, and a second right face. A hinge is coupled between the first right face and the second left face. The second folding guide half has an extended position and an alternate folded position. The first folding guide half and the second folding guide half assist in folding an article of clothing and also serve as a clothes hanger.

5 Claims, 4 Drawing Sheets

(56) References Cited

U.S. PATENT DOCUMENTS

| | | | | |
|---|---|---|---|---|
| 6,293,443 | B1 * | 9/2001 | Nykoluk | A47G 25/30 223/89 |
| 6,675,997 | B1 * | 1/2004 | Gouldson | A47G 25/18 223/89 |
| 9,687,099 | B2 | 6/2017 | Snow | |
| 2015/0182055 | A1 | 7/2015 | Gouldson | |

* cited by examiner

FOLDING GUIDE HANGER

The disclosure and prior art relates to clothes hangers and more particularly pertains to a new clothes hanger for folding clothing.

BRIEF SUMMARY OF THE INVENTION

An embodiment of the disclosure meets the needs presented above by generally comprising a rectangular prismatic first folding guide half having a first front face, a first rear face, a first top face, a first bottom face, a first left face, and a first right face. The first top face has a hook aperture extending through to the first bottom face. A hanger hook has a hooked portion, a shaft portion, and a flared end coupled to the shaft portion. The shaft portion is coupled within the hook aperture with the flared end adjacent the first bottom face. A hinge is coupled to the first right face of the first folding guide half. A rectangular prismatic second folding guide half has a second front face, a second rear face, a second top face, a second bottom face, a second left face, and a second right face. The second left face is coupled to the hinge. The second folding guide half has an extended position aligned with the first folding guide half and an alternate folded position with the second front face adjacent the first front face. The first folding guide half and the second folding guide half assist in folding an article of clothing when moving from the extended position to the alternate folded position. The first folding guide half and the second folding guide half function as a clothes hanger when in the folded position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
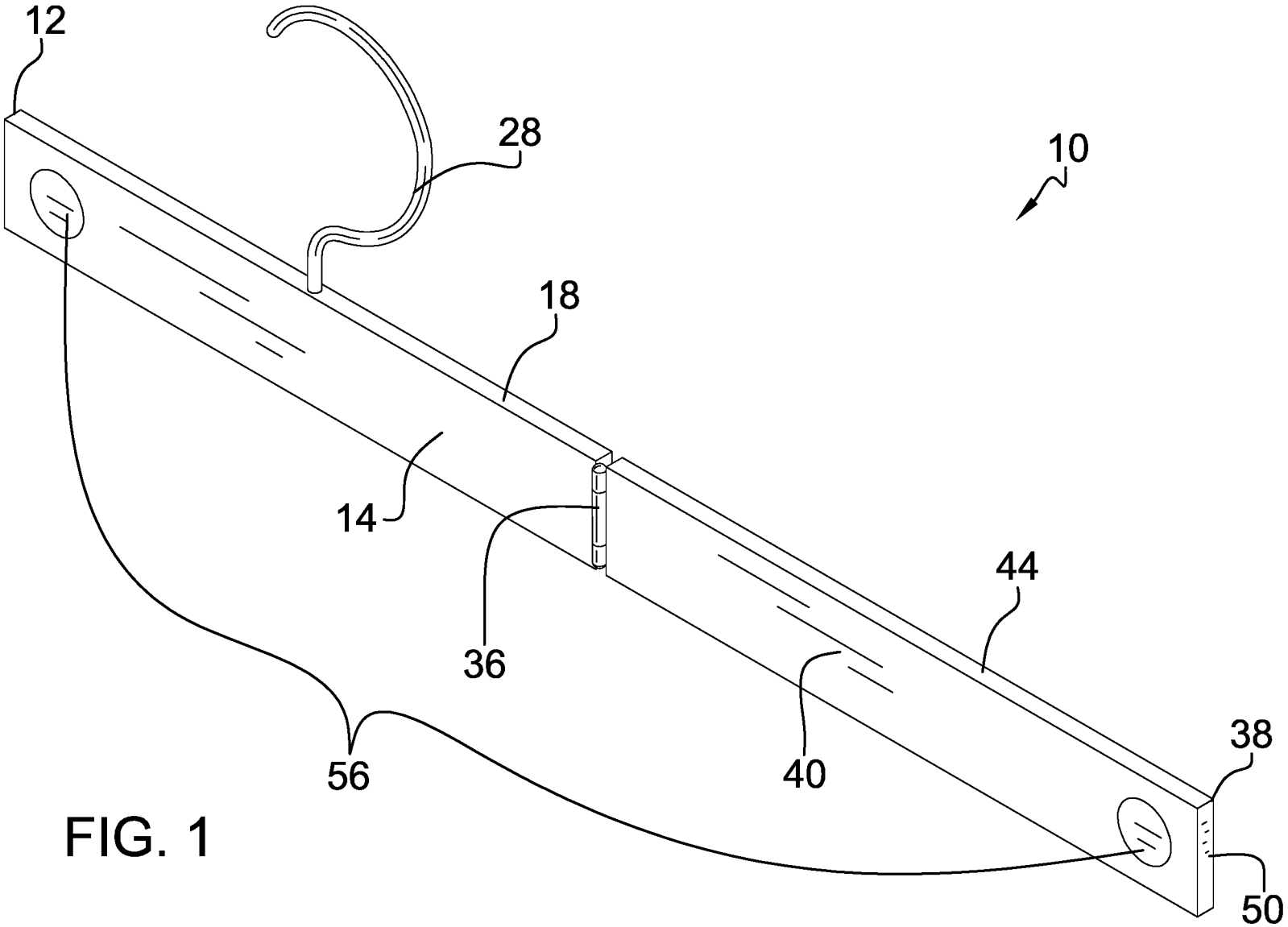
FIG. 1 is an isometric view of a folding guide hanger according to an embodiment of the disclosure.
Figure 2:
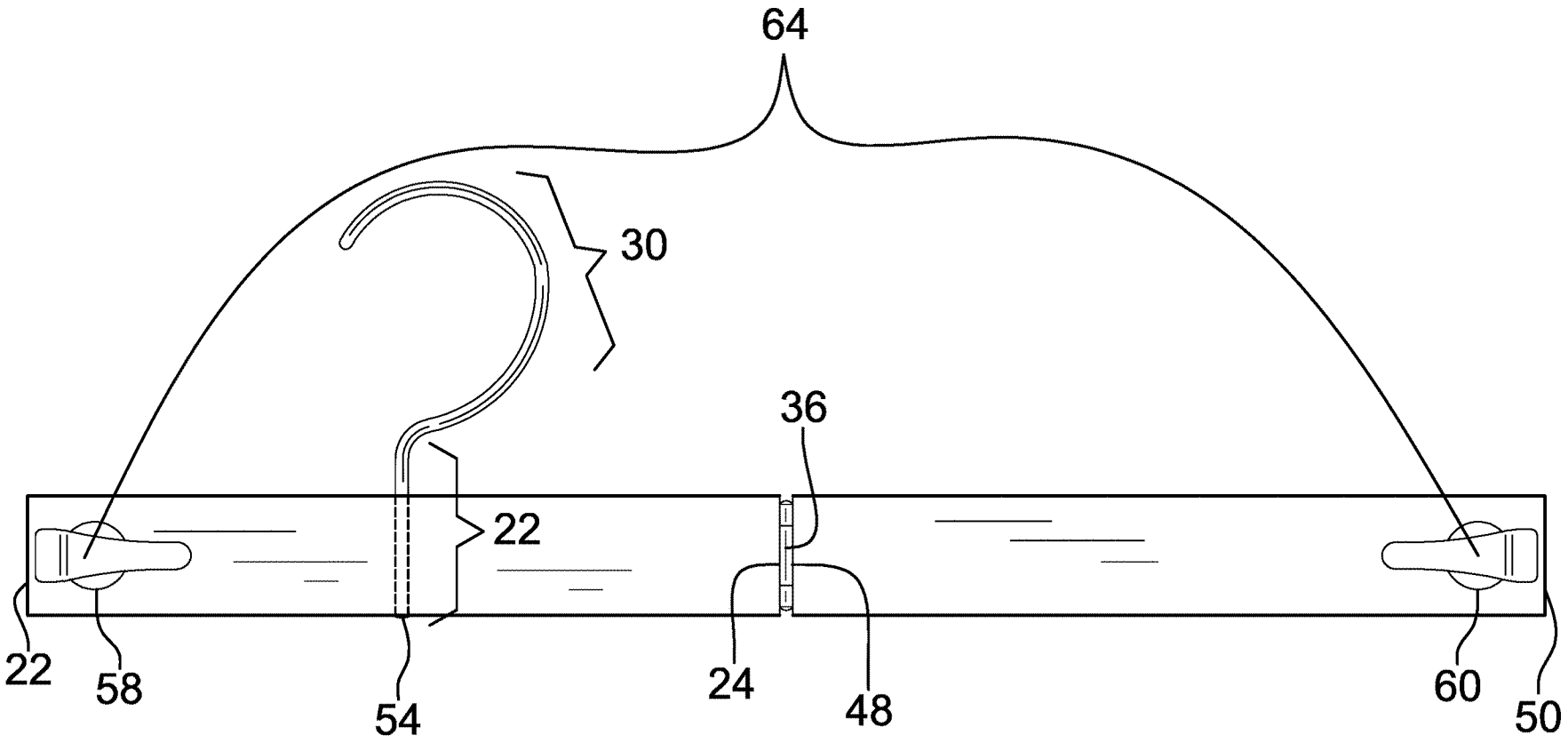
FIG. 2 is a front elevation view of an embodiment of the disclosure.
Figure 3:
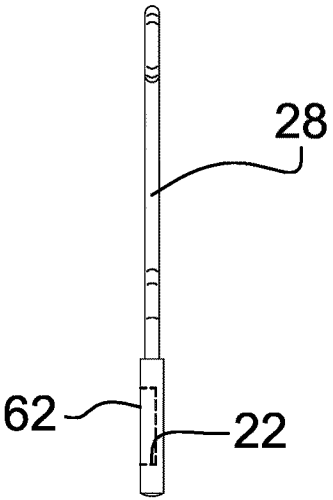
FIG. 3 is a side elevation view of an embodiment of the disclosure.
Figure 4:
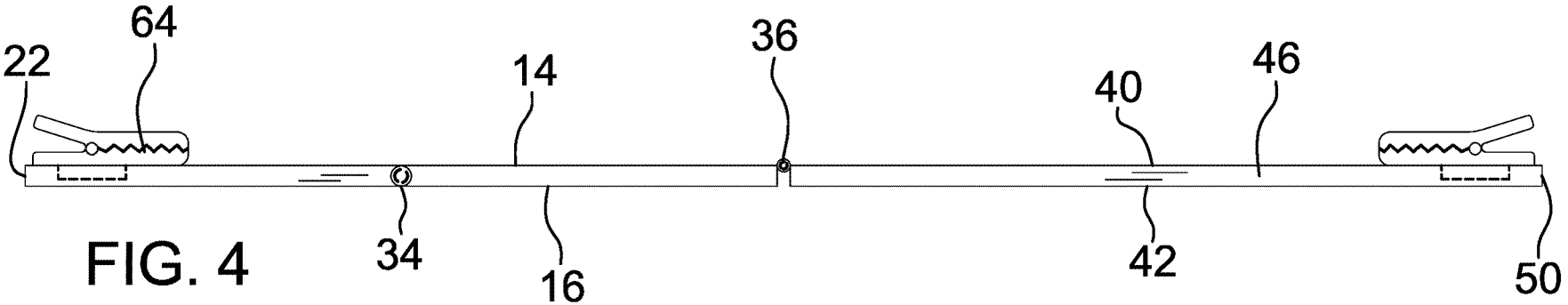
FIG. 4 is a bottom plan view of an embodiment of the disclosure.
Figure 5:
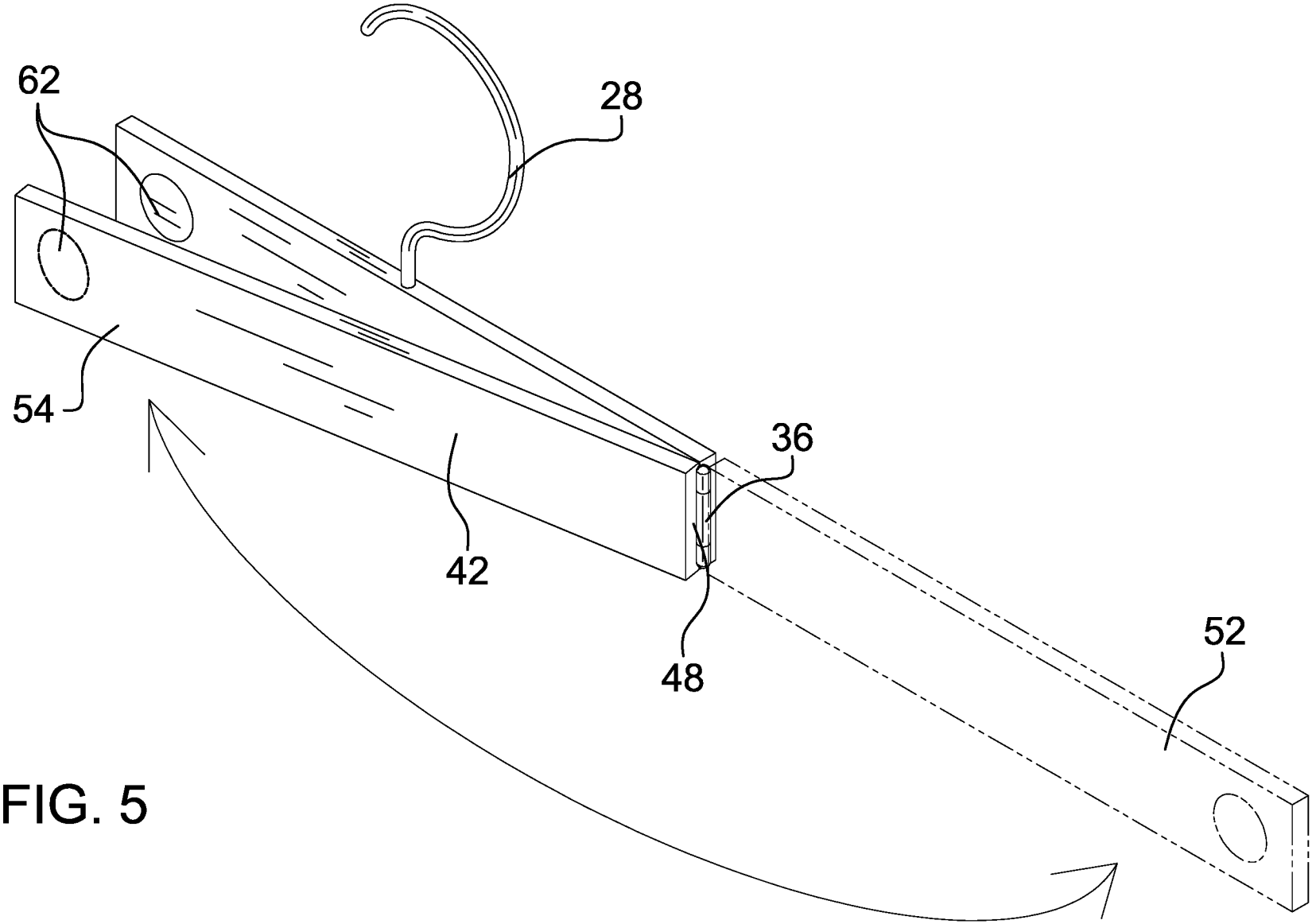
FIG. 5 is an in-use isometric view of an embodiment of the disclosure.

With reference now to the drawings, and in particular to FIGS. 1 through 5 thereof, a new clothes hanger embodying the principles and concepts of an embodiment of the disclosure and generally designated by the reference numeral 10 will be described.

As best illustrated in FIGS. 1 through 5, the folding guide hanger 10 generally comprises a first folding guide half 12. The first folding guide half is a rectangular prism having a first front face 14, a first rear face 16, a first top face 18, a first bottom face 20, a first left face 22, and a first right face 24. The first top face 18 has a hook aperture 26 extending through to the first bottom face 20. The hook aperture 26 may be medially disposed between the first left face 22 and the first right face 24. A hanger hook 28 has a hooked portion 30, a shaft portion 32, and a flared end 34 coupled to the shaft portion 32. The shaft portion 32 is coupled within the hook aperture 26 with the flared end 34 adjacent the first bottom face 20. A hinge 36 is coupled to the first right face 24 of the first folding guide half. A second folding guide half 38 is coupled to the hinge 36. The second folding guide half is a rectangular prism having a second front face 40, a second rear face 42, a second top face 44, a second bottom face 46, a second left face 48, and a second right face 50. The second left face 48 is coupled to the hinge 36. The second folding guide half 38 has an extended position 52 aligned with the first folding guide half 12 and an alternate folded position 54 with the second front face 40 adjacent the first front face 14.

A pair of attachment mechanisms 56 comprises a first attachment mechanism 58 coupled within the first front face 14 of the first folding guide half proximal the first left face 22 and a second attachment mechanism 60 coupled within the second front face 40 of the second folding guide half proximal the second right face 50. The first attachment mechanism 58 is selectively engageable with the second attachment mechanism 60 to maintain the second folding guide half 38 in the folded position 54. The pair of attachment mechanisms 56 may be a pair of magnets 62. A pair of clips 64 may be coupled to the first rear face 16 and the second rear face 42. The pair of clips 64 is configured to secure an article of clothing.

In use, the first folding guide half 12 and the second folding guide half 38 assist in folding the article of clothing when moving from the extended position 42 to the alternate folded position 54. The pair of clips 64 may be attached to a t-shirt to assist in the folding process. The first folding guide half 12 and the second folding guide half 38 also function as a clothes hanger when in the alternate folded position 54. The first folding guide half 12 and the second folding guide half 38 may secure a pair of pants therebetween secured by the pair of attachment mechanisms 56.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A folding guide hanger comprising:

a first folding guide half, the first folding guide half being a rectangular prism having a first front face, a first rear face, a first top face, a first bottom face, a first left face, and a first right face, the first top face having a hook aperture extending through to the first bottom face;

a hanger hook coupled to the first folding guide half, the hanger hook having a hooked portion, a shaft portion, and a flared end coupled to the shaft portion, the shaft portion being coupled within the hook aperture with the flared end adjacent the first bottom face;

a hinge coupled to the first folding guide half, the hinge being coupled to the first right face;

a second folding guide half coupled to the hinge, the second folding guide half being a rectangular prism having a second front face, a second rear face, a second top face, a second bottom face, a second left face, and a second right face, the second left face being coupled to the hinge, the second folding guide half having an extended position aligned with the first folding guide half and an alternate folded position with the second front face adjacent the first front face;

wherein the first folding guide half and the second folding guide half assist in folding an article of clothing when moving from the extended position to the alternate folded position, the first folding guide half and the second folding guide half functioning as a clothes hanger when in the folded position; and a pair of attachment mechanisms, the pair of attachment mechanisms comprising a first attachment mechanism coupled within the first front face of the first folding guide half proximal the first left face and a second attachment mechanism coupled within the second front face of the second folding guide half proximal the second right face, the first attachment mechanism being selectively engageable with the second attachment mechanism to maintain the first folding guide half and the second folding guide half in the folded position.

2. The folding guide hanger of claim 1 further comprising the hook aperture of the first folding guide half being medially disposed between the first left face and the first right face.

3. The folding guide hanger of claim 1 further comprising a pair of clips, the pair of clips being coupled to the first rear face and the second rear face, the pair of clips being configured to secure the article of clothing.

4. The folding guide hanger of claim 1 further comprising the pair of attachment mechanisms being a pair of magnets.

5. A folding guide hanger comprising:

a first folding guide half, the first folding guide half being a rectangular prism having a first front face, a first rear face, a first top face, a first bottom face, a first left face, and a first right face, the first top face having a hook aperture extending through to the first bottom face, the hook aperture medially disposed between the first left face and the first right face;

a hanger hook coupled to the first folding guide half, the hanger hook having a hooked portion, a shaft portion, and a flared end coupled to the shaft portion, the shaft portion being coupled within the hook aperture with the flared end adjacent the first bottom face;

a hinge coupled to the first folding guide half, the hinge being coupled to the first right face;

a second folding guide half coupled to the hinge, the second folding guide half being a rectangular prism having a second front face, a second rear face, a second top face, a second bottom face, a second left face, and a second right face, the second left face being coupled to the hinge, the second folding guide half having an extended position aligned with the first folding guide half and an alternate folded position with the second front face adjacent the first front face;

a pair of attachment mechanisms, the pair of attachment mechanisms comprising a first attachment mechanism coupled within the first front face of the first folding guide half proximal the first left face and a second attachment mechanism coupled within the second front face of the second folding guide half proximal the second right face, the first attachment mechanism being selectively engageable with the second attachment mechanism to maintain the second folding guide half in the folded position;

a pair of clips, the pair of clips being coupled to the first rear face and the second rear face, the pair of clips being configured to secure an article of clothing; and wherein the first folding guide half and the second folding guide half assist in folding the article of clothing when moving from the extended position to the alternate folded position, the first folding guide half and the second folding guide half functioning as a clothes hanger when in the folded position.

* * * * *